US009562337B1

(12) United States Patent
Tremmier et al.

(10) Patent No.: US 9,562,337 B1
(45) Date of Patent: Feb. 7, 2017

(54) PILE HAMMER

(71) Applicants: Jonathan Tremmier, Rising Fawn, GA (US); Don Warrington, Rising Fawn, GA (US)

(72) Inventors: Jonathan Tremmier, Rising Fawn, GA (US); Don Warrington, Rising Fawn, GA (US)

( * ) Notice: Subject to any disclaimer, the term of this patent is extended or adjusted under 35 U.S.C. 154(b) by 461 days.

(21) Appl. No.: 14/296,530

(22) Filed: Jun. 5, 2014

Related U.S. Application Data

(60) Provisional application No. 61/831,657, filed on Jun. 6, 2013.

(51) Int. Cl.

| | |
|---|---|
| ***B23B 45/16*** | (2006.01) |
| ***B25D 9/00*** | (2006.01) |
| ***B25D 11/00*** | (2006.01) |
| ***B25D 13/00*** | (2006.01) |
| ***B25D 16/00*** | (2006.01) |
| ***E21B 1/00*** | (2006.01) |
| ***E02D 7/10*** | (2006.01) |

(52) U.S. Cl.
CPC ..... *E02D 7/10* (2013.01)

(58) Field of Classification Search
CPC ..... E02D 7/10; E21B 34/10; E21B 2034/007
USPC ..... 173/90, 200–201, 122, 127–128, 133, 173/135–138
See application file for complete search history.

(56) References Cited

U.S. PATENT DOCUMENTS

| | | | | |
|---|---|---|---|---|
| 3,782,483 | A * | 1/1974 | Wandell | E02D 7/10 173/133 |
| 3,927,722 | A * | 12/1975 | Frederick | E02D 7/10 173/125 |
| 4,033,139 | A * | 7/1977 | Frederick | E02B 17/027 173/DIG. 1 |
| 4,099,580 | A * | 7/1978 | Ross | B25D 11/125 173/118 |
| 4,290,489 | A * | 9/1981 | Leavell | B25D 9/14 173/133 |
| 4,611,742 | A * | 9/1986 | Rieker et al. | B25C 5/15 173/121 |
| 4,806,085 | A * | 2/1989 | Costa | F04C 15/06 418/184 |
| 6,023,826 | A * | 2/2000 | Harrelson, III | B25B 27/0028 29/213.1 |
| 6,148,507 | A * | 11/2000 | Swanson | B21J 15/105 29/243.53 |
| 6,318,514 | B1 * | 11/2001 | Hinkens | B60T 11/22 188/73.32 |
| 7,306,047 | B2 * | 12/2007 | Oda | B25D 9/04 173/135 |
| 8,025,135 | B1 * | 9/2011 | Lu | F16F 9/3235 188/282.5 |
| 8,789,617 | B2 * | 7/2014 | Konecnik | B25D 9/04 173/138 |

(Continued)

*Primary Examiner* — Robert Long
(74) *Attorney, Agent, or Firm* — Stephen J. Stark; Miller & Martin PLLC

(57) ABSTRACT

An improved pile hammer provides a cylinder, such as one with a uniform interior diameter wall and uses a piston ram to cycle up and down therein to contact an anvil on a downstroke. The anvil preferably provides a cavity to both lessen the weight and improve upward force on the ram for the upstroke. An air inlet is preferably located above an air outlet which was not possible with prior art designs. An air reservoir can be located above and external to the wall in the cylinder.

20 Claims, 3 Drawing Sheets

(56) References Cited

U.S. PATENT DOCUMENTS

| | | | | |
|---|---|---|---|---|
| 2004/0124272 | A1* | 7/2004 | Yacoub | F02M 47/027 239/533.2 |
| 2005/0039907 | A1* | 2/2005 | Madison | E03B 3/15 166/67 |
| 2005/0178558 | A1* | 8/2005 | Kolle | E21B 47/14 166/373 |
| 2006/0213676 | A1* | 9/2006 | Jinnings | E02D 7/10 173/184 |
| 2007/0110598 | A1* | 5/2007 | Jacobs | F04B 35/045 417/397 |
| 2007/0240683 | A1* | 10/2007 | Zahner | B25C 1/08 123/46 H |
| 2008/0190988 | A1* | 8/2008 | Pedicini | B25C 1/04 227/130 |
| 2012/0210974 | A1* | 8/2012 | Adams | B23Q 5/033 123/253 |
| 2012/0286014 | A1* | 11/2012 | Pedicini | B25C 1/06 227/4 |
| 2014/0208575 | A1* | 7/2014 | Jagdale | E02F 3/966 29/525.02 |

* cited by examiner

PILE HAMMER

CLAIM OF PRIORITY

This application claims the benefit of U.S. Provisional Patent Application No. 61/831,657 filed Jun. 6, 2013 which is incorporated herein by reference in its entirety.

FIELD OF THE INVENTION

The present invention relates to an improved pile hammer construction.

BACKGROUND OF THE INVENTION

Pile hammers have been manufactured for well over one hundred years. One early model of a very similar pile hammer is still manufactured by the company which currently manufactures and markets the hammer produced by the company which obtained that patent in the late 1800's. As one might imagine, various improvements occurred to the basic pile hammer design over the years.

Many pile hammers rely on an external source of compressed air, steam, hydraulic fluid or rope release. Some hammers are single acting air/steam hammers. These are the oldest mechanically powered hammer types. A ram is moved upward by compressed air or steam in a cylinder acting against a piston. Prior to reaching the rated stroke position the pressure under the piston is released and the ram first coasts on to the rated stroke and then falls under the influence of gravity. Just before hitting the bottom, pressure is again allowed to enter the cylinder.

In an effort to make pile hammers faster, air or steam pressure can be applied to the ram during its descent. These are called double or differential acting air/steam hammers. These designs may allow for shorter stroke to achieve a comparable energy rating to single acting hammers. However, this type hammer is more complex and timing issues are more critical than for the single acting hammers. Also, in hard driving, the hammers can experience upflips (the pile and thus the ram rebound too strongly) and the operator may be forced to reduce the pressure and thus the energy of the hammer. For these reasons, these style hammers are typically given a hammer efficiency of 50%.

Vulcan Iron Works, Inc. manufactured two prototype designs of a different type of hammer in the early 1980's. The "Model 300" was tested in 1982 and the SC3 which was apparently developed in late 1981 and then tested in the spring of 1983. Unfortunately, the Model 300 and/or SC3 prototypes probably do not qualify as "experimental use" even though this design has not been in use for over thirty years. Apparently the SC3 design was tested twice on projects in west Tennessee in late summer of 1983. Although the tests were deemed to be successful, the impact velocity of the ram was determined to be deficient due to the positioning of the ports which tended to reduce the impact velocity of the ram.

The Model 300 and the SC3 had a piston type ram with slots extending longitudinally on the ram which admitted air both just before and just after impact. These slots directed the fluid to enter the ram cylinder and internally. The compressed air pushed the ram upward until the exhaust ports were encumbered. The ram then proceeded upwardly to the top of the stroke, falling again to impact (under the influence of gravity) while compressing the air again during the down stroke to impact the anvil once again. This step made the process "one ended" and produced a hammer so that the ram would be thrown upwards and allowed it to fall downward and impact the pile with a solid anvil compressing the air after it passed the exhaust ports. The SC3 design was also a two-piece cylinder design having two different diameters which was difficult to assemble and run together due to the tolerances required by the construction. It provided a square reservoir that tended to bulge during pressurization. Furthermore, the exhaust was at the top and the piston had a larger diameter cylinder than the ram.

Additionally, this hammer did not have a stroke control feature, and, in fact, the hammer was prone to air locking which required disassembly to reset due possibly to insufficient air reservoir space. Another design defect included inadvertent starting, a significant safety concern which could also have been due to insufficient air reservoir space. When the offshore market collapsed in the early 1980's with oil prices, Vulcan decided not to commercialize the product and abandoned the project.

Accordingly, after almost thirty years, the applicant has decided to resurrect portions of the abandoned design as well as improve its observed deficiencies in an effort to provide an improved pile hammer construction to overcome defects that contributed to its abandonment by earlier efforts.

SUMMARY OF THE INVENTION

It is an object of at least some embodiments of the present invention to provide an improved single-compound hammer.

It is another object of the present invention to provide an improved pile hammer design.

Another object of many embodiments of the present invention is to provide an improved single compound hammer which increases the impact velocity of the ram over prior art designs.

Another object of many embodiments of the present invention is to provide a stroke control feature.

Another object of many embodiments of the present invention is to provide a one piece exterior construction and/or single cylinder style design.

Accordingly, and in accordance with a presently preferred embodiment of the present invention, an exterior cylinder is utilized to provide a one piece cylinder of uniform interior diameter and possibly an enlarged fluid reservoir about a ram and piston having a new outer diameter configuration for at least some embodiments. This construction of the preferred embodiment is believed to simplify the operator's job of installing and using the hammer. Furthermore, an exterior mode of force, whether it be steam, air, or other fluid can be provided to an inlet which directs the piston and ram upwardly possibly with a full length reservoir. At a predetermined point, internal ports of the ram communicate pressure from the ram to assist in exhausting air below the ram allowing the ram to proceed down towards a preferably improved anvil until the port is closed off which allows the air under the piston to then be compressed to start the next cycle. The improved anvil, if utilized, is hollowed out to provide a cavity rather than solid to (a) reduce weight and/or (b) provide additional air volume for upstroke energy.

Unlike the possible prior art design, the new design requires a higher predetermined minimum amount of pressure in order to begin the lifting cycle of the ram. A presently preferred embodiment requires at least 90 psi which prevents inadvertent starting as has been prone to happen with the possible prior art, but certainly abandoned, design. Round rather than prior art square reservoirs have been forced to eliminate bulging during pressurization for at least some embodiments.

Furthermore, the possible prior art design was also subject to air locking at intermediate positions which prevented further motion in either direction when attempting to restart. The new design gravitates to the fully down position when fluid is secured to thus provide stroke control. An integral air reservoir possibly with an extra receiver tank such as above the ram or otherwise provides enough air for at least one stroke and no complicated valve structure need be provided for this design. Unlike the possible prior art design, the air inlet in the cylinder is positioned above the outlet which could not occur with the two piece piston/ram structure of the prior art design.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
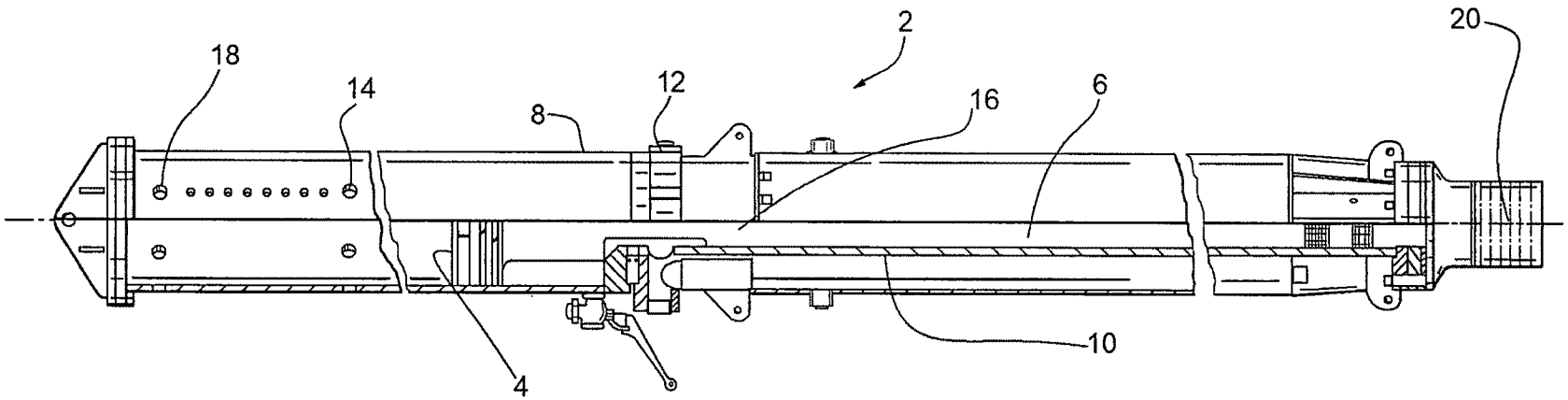
FIG.1 PRIOR ART
FIG. 1 is a prior art partially cutaway view of the SC3.
Figure 4:
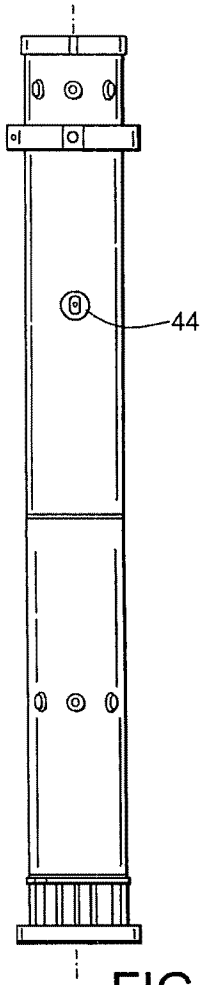
FIG. 4 is a side plan view of the cylinder shown in FIG. 2.

In accordance with the presently preferred embodiment of FIGS. 2-5, a pile hammer 10 is shown. Unlike the embodiment of FIG. 1 which shows a prior art hammer 2 having a separate piston 4 connected to a separate ram 6, as well as first and second cylinder diameters of cylinders 8,10 which complicate the structure, a new design is provided with an integral piston/ram and a single cylinder inner diameter. Furthermore, potentially prior art hammer 2 suffers from a number of other disadvantages, some of which were discussed above.

During operation, air or steam would be provided through inlet 12 pushing the piston upward until the piston passed the first set of vents 14 at which time the higher pressure inside the first cylinder 8 would tend to vent out of the vents 14. This displaced fluid would also be directed internal to the ram 6 through slots 16 through the upper vents 18, thus allowing the piston to coast and then start downwardly until the piston falls down past the first vents 14 wherein the fluid is compressed as the ram 6 proceeds down to contact the anvil 20.

As discussed above, this design was prone to air locking and required two separate cylinders with different inner diameters 6, 8 amongst other problems. The applicant's improved design for pile hammer 30 is shown in FIGS. 2-5 and overcomes many of the shortcomings of the SC1 hammer, if it is prior art.

Specifically, air, steam or other fluid is fed into inlet 32 and then directed through a reservoir 34 down to piston inlet 56 where it enters into the cylinder 38 and drives the piston 40 upwardly preferably upon reaching at least a predetermined pressure. When piston 40 reaches the exhaust port 54, fluid may proceed out ports 46,48 directing fluid to the internal passage 50 of the piston 40 then proceeds downwardly and out lower port 54. The piston then begins a descent after coasting particularly as the air continues through the cutout 42 and ports 46,48 in the desired manner. The piston 40 then drops with the weight of gravity and contacts the anvil 60. The fluid then has built up enough pressure to cycle one more time, etc., and/or as it receives fluid from the reservoir 34.

Meanwhile, anvil 60 can be provided with cavity 61 to (a) lessen its weight to no more than about ⅔ as heavy as a prior art anvil, if not ½ or more, and (b) provide additional air volume for air upstroke energy which was not possible with prior art designs. The cavity 61 has a depth 63 which can typically vary from about ⅓ to about one half of height 65 of anvil 60 and a diameter 67 of at least about ½ of anvil diameter 69 for at least some embodiments. Cavity 61 opens to top 69 of anvil 60 to assist in providing the air volume and upstroke energy improvement for those embodiments having such a feature.

An additional element provides a single cylinder 38 with a constant internal diameter except for ports which does not narrow at an upper portion of the cylinder 38 as the prior art design of SC1 does. The piston and ram are integral and of a common round diameter.

Figure 6:
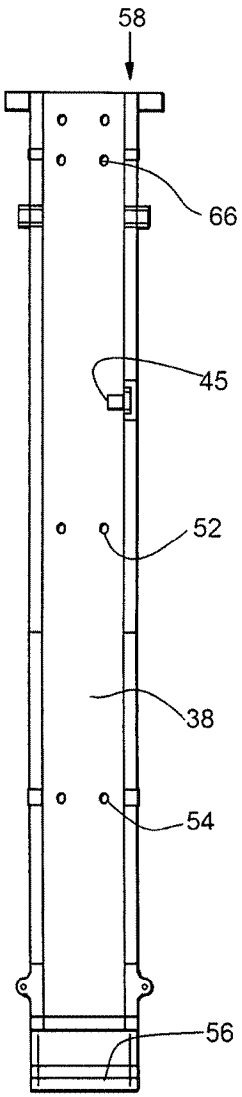
FIG. 6 is a cross sectional view of the cylinder shown in FIGS. 2 and 4.
Figure 5:
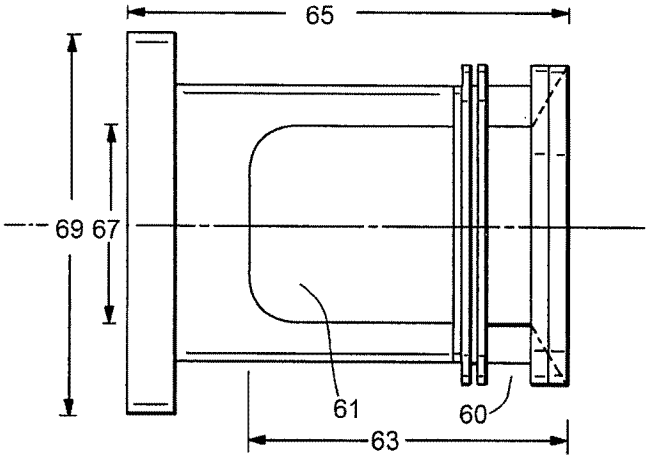
FIG. 5 is a side plan view of the anvil as shown in FIG. 2.

The new design differs from the SC3 in that the ram 40 is directed upwardly and then filled with pressurized air through ports 52 as shown in FIG. 6. Once the bottom set of rings clears the exhaust ports 54, air is introduced into the first exhaust ports 54 with enough pressure to equalize through the ports 46,48. The air does not start to build up in the cylinder 38 until pressure is up and down to the piston 40 passes down below the first exhaust port 54. The piston 40 does not bind on the way up since fluid can vent through upper vents 66 in reservoir area 33. Access 44 provides a piston lock 45 (when installed) such as for transport to hold the piston 40 in the down position.

Unlike prior art designs, this design has an air inlet 32 above the outlet ports 54 which cannot be achieved with the prior art SC3 design as the inlet is at a bottom of the piston cylinder in that design.

This design can also provide a constant inner diameter of the cylinder 38 from top of the anvil 56 to the inlet 32 and from inlet 32 to the top 58.

In the preferred embodiment the rated striking energy is 15,000 pounds. Other designs may be different. Blows per minute for normal stroke without setting can be 50 to 60 or other cycle. Normal stroke in inches can be at least 3 or 4 feet. Operating pressure can be around 100 psi at the hammer and possibly can be requiring at least a minimum such as at least 50-60 psi, or more preferably about 90 psi to move the piston 40 upwardly. Air consumption (adiabatic) can be at least about 250 cubic feet per minute and the required air compressor size desired can be sufficient to meet the consumption.

For preferred embodiments, the bore can be roughly 15 inches with a net area of piston per ram being about 176. The hammer can have a length of roughly 204 inches. The distance across the female jaws can be 20 inches. The width of the female jaws can be 8½ inches. The largest outer diameter of the pile can be 18 inches and the size of hose can be 1½ inches. Other dimensions could apply to other embodiments.

As it relates to weight data, the weight of the striking parts can be 3750 pounds and the weight of the hammer can be 7,600 pounds for a presently preferred embodiments.

Figure 3:
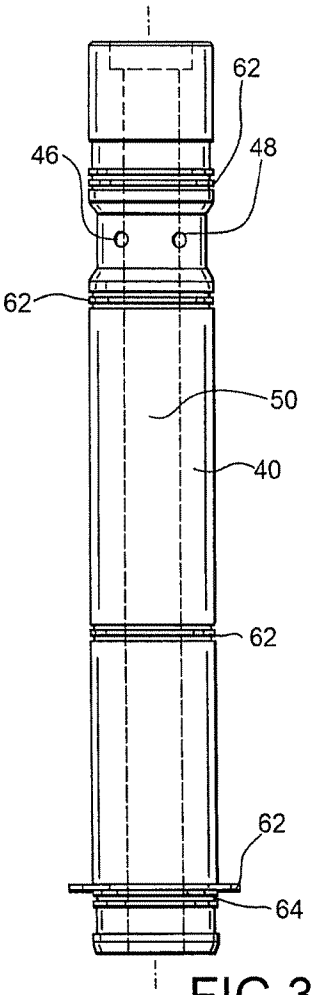
FIG. 3 is a side plan view of a ram prior to installing the rings of the center devices as shown in FIG. 2.
Figure 2:
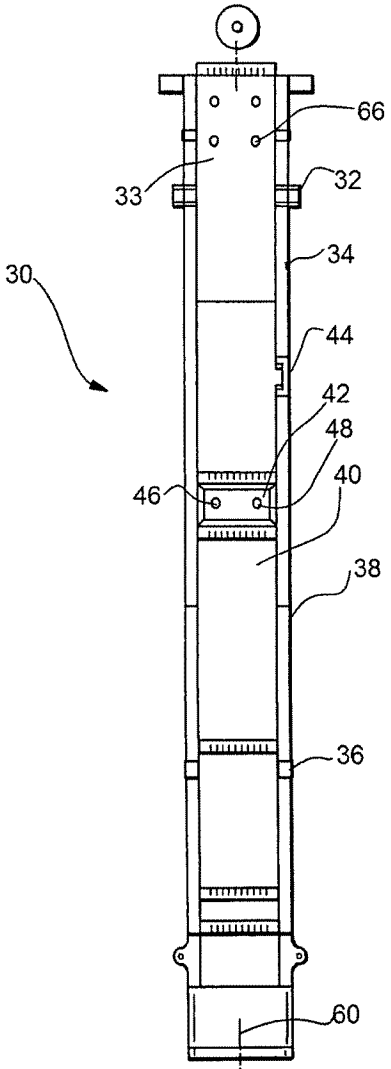
FIG. 2 is a comparative cross-sectional view of the presently preferred embodiment of the present invention.

Rings 62 can extend from grooves 64 in cylinder to assist in providing the pneumatic and/or hydraulic movements as desired within desired tolerances. Numerous grooves 64 are shown in FIG. 3 with it being understood that rigs 62 can be positioned in each to provide the desired fluid seals with the inner diameter of cylinder 38.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pile hammer comprising:

an exterior cylinder having a uniform interior diameter at an interior wall and an air inlet located above an air outlet;

a ram having internal ports which cycles internal to the exterior cylinder;

an anvil connected to the exterior cylinder and contacted by the ram to apply downward force to an object;

wherein said ram cycles within the exterior cylinder with the application of a fluid force under pressure provided through the air inlet causing the ram to move upwardly until vented through the internal ports of the ram to the outlet at which time the ram descends downwardly until contacting the anvil and then while in communication with the inlet, being directed upwardly to repeat a cycle.

2. The pile hammer of claim 1 further comprising a first fluid reservoir in the exterior cylinder radially external to the interior wall.

3. The pile hammer of claim 1 wherein at least about 50 psi of the fluid force is required to move the ram upwardly.

4. The pile hammer of claim 1 further comprising a round cross section fluid reservoir above the ram.

5. The pile hammer of claim 1 wherein the anvil further comprises a cavity upwardly directed towards the ram.

6. The pile hammer of claim 5 wherein a volume of the cavity is at least about ⅓ of a volume of the anvil.

7. The pile hammer of claim 6 wherein the volume of the cavity at least about ½ the volume of the anvil.

8. The pile hammer of claim 1 wherein the ram gravitates to contact with the anvil upon removal of the fluid force to prevent air lock.

9. The pile hammer of claim 1 wherein the ram is integrally formed with a piston.

10. The pile hammer of claim 1 wherein the ports in the ram proceed through side walls of the ram to communicate with fluid below the ram.

11. The pile hammer of claim 10 further comprising seals above and below the ports sealing against the interior wall of the cylinder.

12. A pile hammer comprising:

an exterior cylinder having a interior diameter at an interior wall, an air inlet and an air outlet;

a piston ram having internal ports proceeding through side walls of the piston ram to communicate with fluid below the piston ram;

an anvil connected to the cylinder at a bottom of the cylinder and contacted by the ram to apply downward force to an object, said anvil having an internal cavity of at least ⅓ the volume of the anvil opening towards the piston ram;

wherein said ram cycles within the exterior cylinder with the application of a fluid force under pressure provided through the air inlet causing the ram to move upwardly until vented through the internal ports of the ram to the outlet at which time the ram descends downwardly until contacting the ram and then while in communication with the inlet, being directed upwardly to repeat a cycle.

13. The pile hammer of claim 12 wherein the air inlet is located above the air outlet.

14. The pile hammer of claim 12 further comprising a fluid reservoir in the cylinder is sufficient for at least cycle and a half when pressurized at an operating pressure.

15. The pile hammer of claim 14 wherein the operating pressure is at least about 50 psi.

16. The pile hammer of claim 15 wherein a starting pressure of about 90 psi is required to initially move the piston ram upwardly to begin the cycle.

17. The pile hammer of claim 12 wherein the interior wall of the cylinder has a constant interior diameter.

18. The pile hammer of claim 12 wherein the ram gravitates to contact with the anvil upon removal of the fluid force to prevent air locking.

19. The pile hammer of claim 12 further comprising seals above and below the ports of the piston ram sealing against the interior wall of the cylinder.

20. The pile hammer of claim 12 further comprising a first fluid reservoir in the exterior cylinder radially external to the interior wall.

* * * * *